US005110854A

United States Patent [19]

Ratliff

[11] Patent Number: 5,110,854

[45] Date of Patent: May 5, 1992

[54] WATER-BASED SHIELDING COMPOSITIONS FOR LOCALLY PROTECTING METAL SURFACES DURING HEAT TREATMENT THEREOF

[76] Inventor: Glenn O. Ratliff, Watergate Apartments, #1802, 26241 Lake Shore Blvd., Euclid, Ohio 44132

[21] Appl. No.: 492,346

[22] Filed: Mar. 8, 1990

Related U.S. Application Data

[63] Continuation of Ser. No. 199,310, May 26, 1988, abandoned.

[51] Int. Cl.[5] ..... C08K 3/08

[52] U.S. Cl. ..... 524/439; 524/204; 524/376; 524/386; 524/497; 148/28; 427/156

[58] Field of Search ..... 524/204, 375, 376, 386, 524/439, 555; 148/28; 427/156

[56] References Cited

U.S. PATENT DOCUMENTS

| | | | |
|---|---|---|---|
| 1,190,937 | 7/1916 | Moore . | |
| 1,567,632 | 12/1925 | Whinfrey . | |
| 2,367,978 | 6/1941 | Troy | 427/156 |
| 2,485,176 | 10/1949 | Waterfall . | |
| 2,634,245 | 4/1953 | Arndt . | |
| 2,898,253 | 8/1959 | Schneider . | |
| 3,048,495 | 8/1962 | Petkus et al. . | |
| 3,098,834 | 7/1963 | Jerabek . | |
| 3,151,002 | 9/1964 | Benz et al. . | |
| 3,178,321 | 4/1965 | Satterfield . | |
| 3,178,322 | 4/1965 | Schneider . | |
| 3,297,605 | 1/1967 | Schroader et al. . | |
| 3,345,313 | 10/1967 | Ruhf et al. . | |
| 3,454,433 | 7/1969 | Mueller . | |
| 3,661,820 | 5/1972 | Foreman et al. . | |
| 4,146,516 | 5/1979 | Braum et al. | 524/555 |
| 4,366,185 | 12/1982 | Tanaka et al. | 428/458 |
| 4,719,038 | 1/1988 | Sobata et al. | 524/439 |

*Primary Examiner*—Paul R. Michl
*Assistant Examiner*—Yong S. Lee
*Attorney, Agent, or Firm*—Watts, Hoffmann, Fisher & Heinke Co.

[57] ABSTRACT

An anti-nitriding composition comprising a water-based alkyd resin having suspended therein particulate tin and titanium dioxide; a thixotropic agent maintains the particulates in suspension during storage and application; the composition includes surfactant and co-solvent to impart paint-like characteristics. The composition is suitable for use as a local shield during the heat treatment of metals to prevent nitriding or ferritic nitro-carburization at temperatures in the range of about 850° F. to about 1150° F. The water-based formulation is safe to use and to transport, and has an air drying time at normal working temperatures comparable to those drying times previously achievable only with organic-solvent based anti-nitriding compositions.

6 Claims, No Drawings

WATER-BASED SHIELDING COMPOSITIONS FOR LOCALLY PROTECTING METAL SURFACES DURING HEAT TREATMENT THEREOF

This is a continuation of application Ser. No. 07/199,310 filed on May 26, 1988 now abandoned.

TECHNICAL FIELD

This invention relates to metal surface coating compositions known as "stop-offs" or "resists" for shielding metal during certain case hardening operations and, more specifically, to a water-based stop-off composition for use in nitriding and in ferritic nitrocarburizing (carbonitriding).

BACKGROUND OF THE INVENTION

Case hardening is a heat treating practice by which a thin, hardened "skin" is formed on a steel article. Case hardening generally designates any of three types of hardening processes: carburizing wherein carbon is added to low carbon steel, nitriding wherein nitrogen is added, and nitrocarburizing wherein both carbon and nitrogen are added to the steel. In carburizing, the article is exposed to a gaseous carbon containing atmosphere (gas carburization) or packed in a carbonaceous powder (pack carburization) or immersed in a cyanide-salt bath (liquid carburizing) and heated so that the carbon diffuses into the surface of the steel to form the skin. In nitriding, the steel article is placed in a heated nitrogen containing atmosphere (gas nitriding), or the article is placed in a heated cyanide bath (liquid nitriding) so that the nitrogen from the gas or bath diffuses into the surface to form the skin. (In both liquid carburizing and liquid nitriding, the medium is a molten cyanide salt bath; the temperature at which the case hardening is carried out determines the result). Ferritic nitro-carburizing (carbonitriding) is a combination of gas carburization and nitriding wherein a nitrogen gas, usually ammonia, and an endothermic gas are added to the carburizing gas.

These processes are carried out at temperatures sufficiently high so that nitrogen from the disassociated ammonia or carbon from the carbonaceous powder can diffuse into the steel to form a hardened skin by making iron nitrides and alloys of nitrides and/or carbides through reactions with various trace elements at and just below the surface. Typical gas nitriding temperatures are 925° to 1050° F. whereas typical gas carburization temperatures are above 1600° F. and most often at 1700° F. to 1900° F. Carbonitriding is carried out at temperatures below those required for carburizing, that is at 1400° F to 1650° F.

During case hardening, anti-nitriding and anticarburizing compositions are sometimes employed to shield selected metal surfaces from the nitriding or the carburizing medium, whether gas, liquid or powder. These compositions are called "stop-offs" or "resists."

Stop-offs are typically employed to prevent a predetermined portion of the steel from forming a hardened skin so as to facilitate later machining operations on the unhardened areas.

Prevention of case hardening is a matter of preventing nitrogen or carbon from reaching the surface of the steel by providing a physical shield between the steel and the case-hardening atmosphere or environment. The high temperatures at which case hardening processes are carried out present special problems in formulating stop-offs. To be commercially acceptable, a stop-off should exhibit certain desirable performance characteristics: the stop-off must be capable of effective application to the articles at room temperatures (preferably by an easily practiced technique, such as by "painting" the article with the stop-off); the stop-off must provide a gas impervious shield which not only resists gaseous penetration at high temperatures but also withstands the stresses and strains caused by thermal expansion and contraction of the underlying article; and the stop-off must be easily removable from the article after the case hardening process is complete.

Carburizing takes place at substantially higher temperatures than nitriding or ferritic nitrocarburizing so that carburizing stop-off formulations have been different from those used in nitrogen processes.

One early stop-off technique was to coat metal with pulverized boric acid. The boric acid melted at the elevated operating temperatures to provide a fluent, adherent glaze-like shield. Such a technique is disclosed in U.S. Pat. No. 1,190,937, which teaches a boric acid coating to prevent the decarbonization of steel during heat tempering. Other carburizing stop-off materials have been proposed which employ various alternative formulations, such as the refractory clay and borax or boric acid formulations in U.S. Pat. Nos. 1,567,632, and 3,151,002. The later patent teaches the use of a synthetic resin lacquer as a binder to hold the boric acid crystals in place until an operating temperature sufficiently elevated to melt the boric acid and to coke the resin is reached.

Nitriding and ferritic nitro-carburizing (nitrogen processes) are carried out at temperatures lower than those for carburizing. Nitrogen process frequently employ a layer of tin on the surfaces of the article to be shielded. Electroplating was one technique of providing a tin layer, and where electroplating was not feasible, various tin-bearing coatings have been employed to shield parts of the article. When the article was brought to an elevated operating temperature, the tin in the coating melted to form a coherent, fluent shield. A tin technique, albeit for prevention of carburization in a cyanide bath, is disclosed in U.S. Pat. No. 2,485,176, which teaches a copper/tin (bronze) composition in an organic vehicle.

In order to be easily applied by spraying or painting, some prior art stop-offs were formulated with combustible or flammable resins, as taught in U.S. Pat. No. 2,485,176, wherein the finely powdered metal particles are dispersed in an organic vehicle so as to be sprayable or paintable on surfaces not required to be case-hardened. If further thinning or dilution of these stop-offs was needed, for example after a period of storage or standing open so as to cause the resin to evaporate, additional flammable resin or solvent therefor had to be handled. Thus, use of many prior stop-offs involved the risk of fire or explosion. It can be appreciated that such stop-offs required special ventilation of the work place as well as special handling and storage facilities. Lastly, flammable stop-offs present transportation problems in that they require special packaging, labeling and handling.

In order to ameliorate the dangers and difficulties attendant the use of flammable stop-offs, various proposals have been made for providing non-flammable formulations. U.S. Pat. No. 3,178,321 teaches a wide temperature range (i.e., from about 800° F. to about 1900° F.) protective coating comprising refractory clays in a water-dispersible resin. U.S. Pat. No. 3,454,433 discloses low temperature (i.e., below about 1600° F.) protective ceramic coatings comprising frits and refractory materials in both organic solvent type binder carrier and water-base binder carrier. U.S. Pat. No. 3,661,820 teaches an anti-carburization compound containing boric acid or borax in "water reducible" resins. Although the greater water content of these stop-offs may have improved safety, there was a trade-off in terms of drying techniques and times. The '321 patent reports oven drying at 180° F. In the '433 patent, air drying is followed by baking the water-soluble resinous varnish-containing formulation at about 180° C. to thermoset the binder; drying times are reported in the '820 patent to be around eight hours at room or factory temperatures. Satisfactory use of such stop-offs required either the provision of special elevated temperature drying rooms to hasten drying or a great deal of advance planning coupled with storage space so that the coated articles awaiting treatment could be stored away during drying so as to avoid damage to the wet stop-off surfaces.

Another disadvantage encountered with prior formulations for water-based stop-offs included short-shelf life in contrast to organic solvent based stop-offs; problems with prior formulations included such settling during storage that the particulates could not be stirred up again, as well as rapid hardening after opening the container.

It would be advantageous, therefore, to have a truly water-based stop-off useful in nitrogen processes and characterized by ease of application and quickness of drying before heat treatment, ease of removal afterward, and enhanced safety in the work place.

DISCLOSURE OF THE INVENTION

The present invention provides a new and improved anti-nitriding composition comprising a water-based alkyd resin having particulate tin suspended therein. The inventive composition is safer to use and to transport than flammable prior art formulations and has an air drying time at normal working temperatures comparable to those drying times previously achievable only with organic-solvent based stop-off compositions. The new composition is suitable for use as a local shield during the heat treatment of metals to prevent nitriding or ferritic nitrocarburization at temperatures in the range of about 800°F. to about 1150° F.

Among the advantages provided by the water-based anti-nitriding composition of the present invention is that it is non-flammable and non-combustible, and hence amenable to being freighted by air. Its non-flammable character means that it can be applied in the work place without danger of fire or explosion, and that it can be stored in the work place without special storage provisions, such as a fire-proof cabinet.

Another advantage provided by the water-based anti-nitriding composition of the present invention is that it is easily applied by brushing or dipping or spraying selectively on the part to be shielded and, after heat treatment, the residue of the composition can be easily removed by brushing or wiping off.

According to a preferred embodiment of the invention a metal surface coating composition is provided for selective shielding during heat treatment of the metal surface coated therewith which comprises: a carrier of fast air drying water-reducible alkyd resin having dispersed therein a quantity of granular tin sufficient to form a molten coat of tin thick enough to prevent penetration of the nitriding atmosphere and thin enough so as not to flow onto adjacent metal surfaces; a quantity of filler resistent to degradation at heat treatment temperatures, the amount of filler being sufficient to prevent amalgamation of the molten tin coating so that after heat treatment is complete and the metal surface is cooled, the coating is removable; a quantity of a thixotropic agent sufficient to maintain the tin dispersed in the resin; and a quantity of surfactant in an amount effective to impart paint-like flow characteristics. The composition may also include a co-solvent to increase viscosity and decrease the rate of evaporation of the composition, and may further include an antifreeze.

Further features and advantages of the invention will become apparent from the following description of a preferred embodiment.

DETAILED DESCRIPTION OF THE INVENTION

A preferred fast air drying water-reducible alkyd resin is available from Spencer Kellogg Products as Arolon 585-W-43. A preferred co-solvent is ethylene glycol monobutyl ether, available as Butyl Cellosolve from Union Carbide Corporation. As used in the specification and the claims, the term "fast air drying" when applied to water-based or water-dispersable alkyd resin means an air drying (water-release) time comparable to vinyl-toluenated or styrenated alkyds, and which is less than about thirty minutes at room or factory temperatures of up to about 30° C. The drying time of preferred water-based alkyd resins is sometimes so short that, depending on the conditions under which it is used, such as relative humidity, etc., it may be necessary to add a co-solvent to increase viscosity and decrease the rate of evaporation of the resultant composition so that the composition may be applied with a brush or by dipping or by spraying and still stay fluid enough for such application. Even when such characteristics are not affected by the working environment, a co-solvent may be useful simply to enhance the general handling properties of the resultant composition.

The particulate tin is preferably in powder form, but the particulate size need not be uniform and may vary somewhat, it being known in the art how to chose particulate sizes for optimum behavior at case hardening temperatures. A preferred size is about 325 mesh and a preferred range is 38–43%.

A preferred filler material is titanium dioxide which is resistant to degradation at nitriding and carbonitriding temperatures. The titanium dioxide is preferable of powdered form and size 325 mesh, and is available from Tioxide, Inc.

The thixotropic agent is necessary to keep the particulate tin in suspension during storage and use. The particulate tin is extremely dense, so that should it ever settle during storage, it would be extremely difficult, if not impossible, to resuspend. Standard thixotropic agents, as are known in the art, are various clay compositions. Preferred thixotropic agents are titanates and most preferred are alkanolamine titanates, such as are available from TIL Division, Tioxide UK, Ltd., Cleveland, United Kingdom, under the trade name Tilcom AT23.

The presence of surfactant imparts paint-like qualities to the resin and to the resultant composition, enhancing its paintability and sprayability. Preferred surfactants are non-ionic, such as the octylphenoxypolyethoxyethanols available from Rohm and Haas Company, Philadelphia, Penna., under the trade names Triton 405 and Triton 705.

A quantity of suitable antifreeze may be included if the composition is expected to be exposed to freezing temperatures during storage or transport.

Reference may be made to Tables I and II, below, for the preferred ranges of the ingredients of the inventive stop-offs. It is to be appreciated that the quantities in Table I are expressed as they are for ease of explanation. The formulations of Table I are prepared by mixing and grinding 10–14 ounces of resin with the shown amounts of the other ingredients. Grinding of the tin powder should be at high shear to ensure dispersion, but the time of shearing should not exceed five minutes and the temperature of shearing should be kept below about 100° F. to prevent coagulation. The same conditions and precautions are applicable to the addition of titanium dioxide to the mixture.

TABLE I

| Preferred Ranges | |
|---|---|
| Water-reducible resin | 10–14 fluid ounces |
| Tin powder | 280–460 grams |
| Titanium dioxide | 80–160 grams |
| Thixotropic Agent | 6–14 grams |
| Co-solvent | 15–35 milliliters |
| Antifreeze | 12–30 milliliters |
| Surfactant | 1–5% by wt |

TABLE II

| Preferred Ranges % by weight | |
|---|---|
| Water-reducible resin | about 36–45% |
| Tin powder | about 40–43% |
| Titanium dioxide | about 9–13% |
| Thixotropic Agent | about 1–2% |
| Co-solvent | about 1–3% |
| Antifreeze | about 1–2% |
| Surfactant | about 1–5% |

The preferred formulation for the composition is shown in Table III, below, and is based on 12 (twelve) fluid ounces of Arolon 585-W-43 as a reference against which the other ingredients are measured. (At a density of 8.9 pounds per gallon, 12 fluid ounces of Arolon 585-W-43 weigh about 355–365 grams. As explained in connection with Table I, above, the preferred formulation is expressed in the listed amounts solely as a matter of convenience, and it will be appreciated that the inventive stop-off may be formulated in fractional and whole number multiples of the amounts given in Table III. The amount of tin for 12 oz of resin is preferably between 320 grams and 420 grams. Amounts at and below the lower limit do not reliably provide a coherent, fluent molten tin shield at operating temperatures. Amounts at and above 420 grams result in so much molten tin, that after heat treatment, it is necessary mechanically to grind off the metallic amalgam of tin. The preferred amount of tin powder is 360 grams, which gives a nice balance between a coherent shield and an easily brushed off residue after heat treatment.

The titanium dioxide amount interplays with the amount of tin powder. The titanium dioxide, acting as a filler, should not be present in such a large amount as to interfere with the tin forming a molten shield at operating temperatures, nor be present in such a small amount as to allow the molten tin shield to cool into a metallic mass which cannot be brushed off after heat treatment. An amount of titanium dioxide in the range of about 100 grams to 140 grams is satisfactory, and the preferred amount is 120 grams for 360 grams of powdered tin.

The amount of thixotropic agent is also somewhat dependent on the amount of dense tin powder and titanium dioxide in the resin. An amount of Tilcom AT23 in the range of 8 grams to 12 grams is satisfactory, and the preferred amount, based on 360 grams of tin and 120 grams of titanium dioxide is 10 grams.

Co-solvent may be added in an amount from about 22 grams to about 28 grams. For the preferred formulation, 25 milliliters of butyl Cellusolve were added. (Cellusolve is a trademark of the Union Carbide Corporation). The co-solvent acts to plasticize the mixture as well as to give the mixture more open-time before drying.

Antifreeze may be added in an amount from about 17 milliliters to about 23 milliliters. The preferred formulation contains 20 milliliters of ethylene glycol. The ethylene glycol, in addition to acting as an antifreeze, also acts as a plasticizer and as a wetting agent.

Surfactant may be added in an amount from about 1% to about 5% by wt. For the preferred formulation, 2% of Triton 705 was suitable.

TABLE III

| Preferred Formulation | |
|---|---|
| Water-reducible resin | 12 fluid ounces |
| Aralon 585 | (355–360 grams) |
| Tin powder | 360 grams |
| | (325 mesh) |
| Titanium dioxide | 120 grams |
| | (325 mesh) |
| Thixotropic Agent | 10 grams |
| | (Tilcon AT23) |
| Co-solvent | 25 milliliters |
| | Butyl Cellusolve |
| Antifreeze | 20 milliliters |
| | Ethylene glycol |
| Surfactant | 5% by wt. |
| | Triton 405 or 705 |

The shelf life of the stop-off of the present invention and made according to the preferred formulation was assessed by making a batch as in Table II and allowing the batch to stand in a closed paint can type container at factory temperatures of up to about 30° F. for six months. At six months, the container was opened and the stop-off was observed to be fluid, of a paintable texture and showed no sign of settling or hardening. The container was reclosed and left to stand for another three months, after which time the container was reopened, the stop-off reinspected and the results of the visual inspection found to be the same as at six months. Reinspection at twelve and fifteen months disclosed the condition of the preparation to be unchanged.

While not wishing to be bound by theory, it appears that the highly desirable properties of the stop-off formulation of the present invention may be due to the initial pH of the resin and the buffering action of the other constituents so as to maintain the pH in the range of about 6.5 to 7.5; a pH in this range may prevent the resin from reacting with the tin powder, thus ensuring a long, stable shelf life. The preferred thixotropic agent is an organotitanate having a buffering capacity not provided by other usual thixotropics, such as clays.

EXAMPLE I

The preferred stop-off formulation of Table III was painted onto a section of Nitralloy 135 modified steel and allowed to air dry at room temperature. The steel was heat treated for 90 hours at 975° F.-1025° F. After heat treatment, the stop-off residue appeared gray and powdery. The residue was removed from the heat-treated metal by wiping with a brush and then with a soft cloth.

Many modifications and variations of the invention will be apparent to those skilled in the art in light of the foregoing detailed disclosure. Therefore, it is to be understood that, within the scope of the appended claims, the invention can be practiced otherwise than as described.

I claim:

1. A paintable water-based anti-nitriding composition for a selected surface of a steel article, the composition being suitable for depositing a shield of wipeably removable residue on said surface to prevent its being case hardened in a gas nitriding operation, the composition comprising in weight percent with respect to the herein named ingredients:

about 36–45% by weight of water reducible alkyd resin;

about 38–43% by weight of tin powder;

about 9–13% by weight of powdered titanium dioxide;

about 1–2% by weight alkanolamine titanate thixotropic agent;

about 1–3% by weight ethylene glycol monobutyl ether;

about 1–2% by weight ethylene glycol; and about 1–5% octylphenoxypolyethoxy-ethanol surfactant, the composition being substantially nonreactive in storage.

2. The composition of claim 1 which is nonflammable and noncombustible.

3. The composition of claim 1 which has pH of about 6.5–7.5.

4. A metal article having selected surfaces prepared for being shielded from gas nitriding, said surface having a coating of a composition adapted for depositing a shield of wipeably removable residue on said surface during the nitriding and preventing the thus-coated surface from being case hardened from the nitriding, the composition comprising in weight percent with respect to the herein named ingredients:

about 36–45% by weight of water reducible alkyd resin;

about 38–43% be weight of tin powder;

about 9–13% by weight of powdered titanium dioxide;

about 1–2% by weight alkanolamine titanate thixotropic agent;

about 1–3% by weight ethylene glycol monobutyl and ether;

about 1–2% by weight ethylene glycol; and about 1–5% octylphenoxypolyethoxy-ethanol surfactant, the composition being substantial nonreactive in storage.

5. The article of claim 4 wherein said composition is nonflammable and noncombustible.

6. The article of claim 4 wherein said composition has pH of about 6.5–7.5

* * * * *